US005115639A

United States Patent [19]

Gopp

[11] Patent Number: 5,115,639

[45] Date of Patent: May 26, 1992

[54] DUAL EGO SENSOR CLOSED LOOP FUEL CONTROL

[75] Inventor: Alexander Y. Gopp, Ann Arbor, Mich.

[73] Assignee: Ford Motor Company, Dearborn, Mich.

[21] Appl. No.: 724,394

[22] Filed: Jun. 28, 1991

[51] Int. Cl.[5] ..... F01N 3/20

[52] U.S. Cl. ..... 60/274; 60/276; 60/285; 123/489

[58] Field of Search ..... 123/440, 489, 589; 60/274, 276, 285, 277

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 123/440 |
| 4,304,204 | 12/1981 | Glöcker et al. | 60/276 |
| 4,463,594 | 8/1984 | Raff et al. | 123/440 |
| 4,526,147 | 7/1985 | Grob | 123/440 |
| 4,534,330 | 8/1985 | Osuga et al. | 123/440 |
| 4,693,076 | 9/1987 | Chujo et al. | 60/274 |
| 4,831,838 | 5/1989 | Nagai et al. | 60/274 |
| 4,840,027 | 6/1989 | Okumura et al. | 60/274 |
| 4,854,124 | 8/1989 | Tamura | 60/274 |

*Primary Examiner*—Ira S. Lararus
*Assistant Examiner*—L. Heyman
*Attorney, Agent, or Firm*—Peter Abolins; Roger L. May

[57] ABSTRACT

Air/fuel ratio control for an internal combustion engine includes the use of a first exhaust gas oxygen sensor (EGO) upstream of a catalytic converter and a second exhaust gas oxygen sensor downstream of the catalytic converter. The output of the first EGO sensor is passed through a high pass filter and then combined in a summer with the output of the second EGO sensor. The output of the summer is applied to a proportional and integral controller which then provides an output used to generate the fuel control signal.

9 Claims, 6 Drawing Sheets

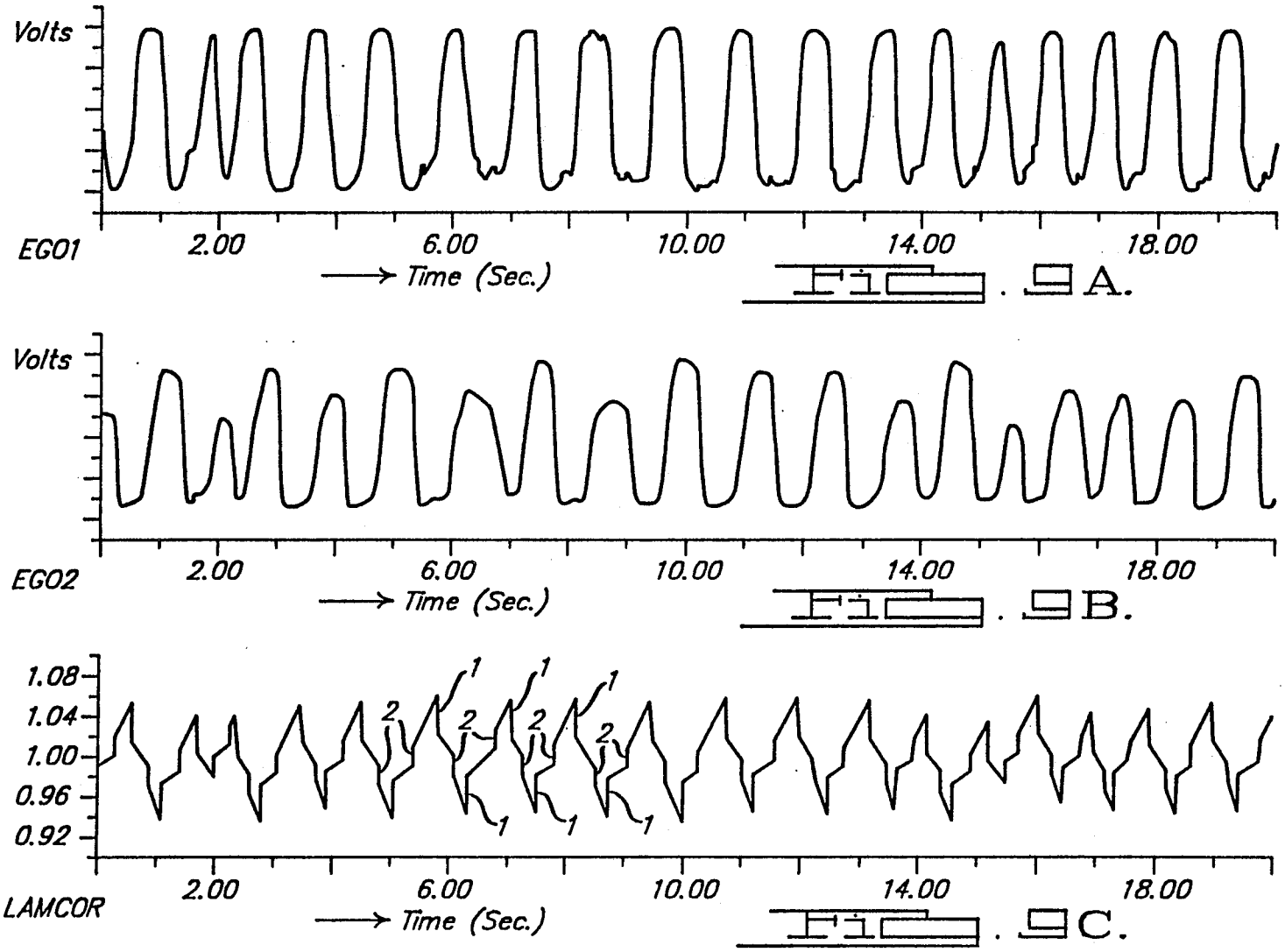
Volts
EGO1
2.00
6.00
10.00
14.00
18.00
Time (Sec.)
A.
Volts
EGO2
2.00
6.00
10.00
14.00
18.00
Time (Sec.)
B.
1.08
1.04
1.00
0.96
0.92
LAMCOR
2.00
6.00
10.00
14.00
18.00
Time (Sec.)
C.

DUAL EGO SENSOR CLOSED LOOP FUEL CONTROL

BACKGROUND OF THE INVENTION

1. Field of the Invention

This invention relates to emission control of internal combustion engines. In particular, the invention relates to an air/fuel ratio closed loop fuel control of an internal combustion engine equipped with two exhaust gas oxygen (EGO) sensors and a three way catalytic converter. The EGO sensors are located upstream and downstream of the catalyst.

2. Prior Art

It is known that catalyst efficiency is greatly affected by the ratio of air to fuel in the mixture supplied to an engine. If the air/fuel ratio is kept in a narrow range at stoichiometric ratio, catalyst conversion efficiency is high for both oxidation and reduction conversions. Air/fuel stoichiometric ratio is defined as the ratio containing air and fuel in such proportions that in perfect combustion both would be completely consumed, and air/fuel ratio LAMBDA is defined as the amount by weight of air divided by the amount by weight of fuel over air/fuel stoichiometric ratio. The purpose of any closed loop fuel control system is to keep the air/fuel ratio in this narrow range known as a conversion window.

It is also known that a control system utilizing one EGO sensor located either before or after a catalyst does not maintain the air/fuel ratio consistently inside the conversion window. Control systems with one EGO sensor located before a catalyst have acceptable time response characteristics but exhibit long term drift due to EGO sensor contamination and aging. On the other hand, control systems with one EGO sensor located after a catalyst have unacceptable time response characteristics but exhibit good long term stability and can indicate a narrow conversion window. Therefore, a control system utilizing advantages of both EGO sensors, i.e., good time response of an upstream EGO sensor and high accuracy of a downstream EGO sensor, is advantageous.

A number of closed loop fuel control systems utilizing both EGO sensors have been proposed but none are completely satisfactory. U.S. Pat. Nos. 3,939,654 issued to Creps and 4,027,477 issued to Storey describe a dual EGO sensor closed loop fuel control system having two control loops. The first control loop includes an upstream EGO sensor and a proportional or proportional with phase lead controller. The second control loop includes a downstream EGO sensor and a dual integrator controller. This arrangement of the control system precludes the usage of integral or proportional and integral controllers in both control loops simultaneously because such a control system is inherently unstable and can not be made stable by calibration. The drawback of these systems is a low accuracy of the first control loop with a proportional controller. The control accuracy may even become unacceptable when the second control loop is not operational as is the case during initial operation before the downstream EGO sensor reaches its operational temperature.

Other teachings, represented by U.S. Pat. Nos. 4,831,838 issued to Nagai et al and 4,840,027 issued Okumura et al, utilize a proportional and integral (PI) controller in the first control loop with an upstream EGO sensor. In one embodiment of these patents, calibratable parameters of the PI controller may be modified based on the output of a downstream EGO sensor, the modified parameters being a skip amount, or jumpback, and an integration amount, or ramp. Some other control system parameters such as time delay and reference voltage may also be modified based on the output of a downstream EGO sensor.

In another embodiment of the same patents, the output of a downstream EGO sensor is used to generate a second air/fuel ratio correction amount which is used as a multiplier in the main fuel equation (the main fuel equation will be introduced later). In both embodiments, a correction introduced by a downstream EGO sensor has a very low frequency limit cycle superimposed on a relatively high frequency limit cycle produced by an upstream EGO sensor control loop. It results in an undesirable effect known in the control field as beat frequency. Moreover, the initial response of a downstream EGO sensor is so slow that elaborate procedures are incorporated to mitigate this disadvantage. Accordingly, both approaches to a dual EGO fuel control system have been found to be unsatisfactory.

Another known control technique using dual EGO sensors, one upstream and one downstream of the catalyst, is a cascade control wherein a signal from the downstream EGO sensor is applied to a summer with a reference signal. The output of the summer is applied to a first proportional and integral controller. A signal from the upstream EGO sensor is applied to a summer and a reference, the reference being the output of the first proportional and integral controller. The output of the second summer is applied to a second proportional and integral controller which then generates the feedback signal to control engine air/fuel ratio.

In another scheme similar to the one just mentioned, both of the summers have an applied reference signal. The output of the first proportional and integral controller is not applied to the second summer but instead controls the parameters of the second proportional and integral controller. This is known as parametric control because the parameters of the second controller are controlled by the output of the first controller. Both this system and the previous system are relatively slow in operation. With respect to the later, parametric control, when a parameter is changed, such as the jumpback, ramp, or delay of a control function, it may well take minutes for the effect to be felt. Further, the system is slow to start. It would be desirable to overcome these problems.

Applicant's invention has a much faster response and uses a single proportional and integral controller having inputs from both the upstream and the downstream EGO sensor.

SUMMARY OF THE INVENTION

This invention includes a dual EGO fuel control system for an internal combustion engine and utilizes a single PI controller having as an input a combination of output signals from upstream and downstream EGO sensors. The combination incorporates an output of a high pass filter which acts as a real time differentiator and is connected to an output of the upstream EGO Sensor.

This invention overcomes the problems and disadvantages discussed above in connection with the prior art and provides an apparatus for fuel control system. In one embodiment of the invention, an internal combustion engine, having a catalytic converter and two EGO sensors, one located upstream and another located downstream of the catalyst, is provided with fuel control system. The control system includes: a first comparator for generating a first upstream signal from the output signal of the EGO sensor located upstream of a catalyst, the first signal having the same absolute value (e.g., "one"), but varying in sign as a function of the upstream output signal; a second comparator for generating a second signal as a function of the downstream output signal of the EGO sensor located downstream of a catalyst, the second signal having the same absolute value but varying in sign from the downstream output signal; corrective means using a high pass filter responsive to the first signal to generate a third signal; means to combine the scaled second signal with the third signal to generate a fourth signal; and control means using a proportional and integral controller responsive to the fourth signal to generate a fifth signal for application as an air/fuel ratio correction amount in a main fuel equation. The control system further provides for control during engine initial operation while one or both EGO sensors have not reached their operational temperatures.

In another embodiment of the invention, limiting means are used instead of the second comparator to improve fuel control operation with new catalytic converters.

BRIEF DESCRIPTION OF THE DRAWINGS

FIG. 8 is a schematic diagram of a control circuit in accordance with an embodiment of this invention; and FIGS. 9A, 9B, and 9C are graphical representations of the output of an upstream EGO sensor, the output of a downstream EGO sensor, and the output of a proportional and integral controller, respectively, with respect to time.

DESCRIPTION OF THE PREFERRED EMBODIMENT

Figure 1:
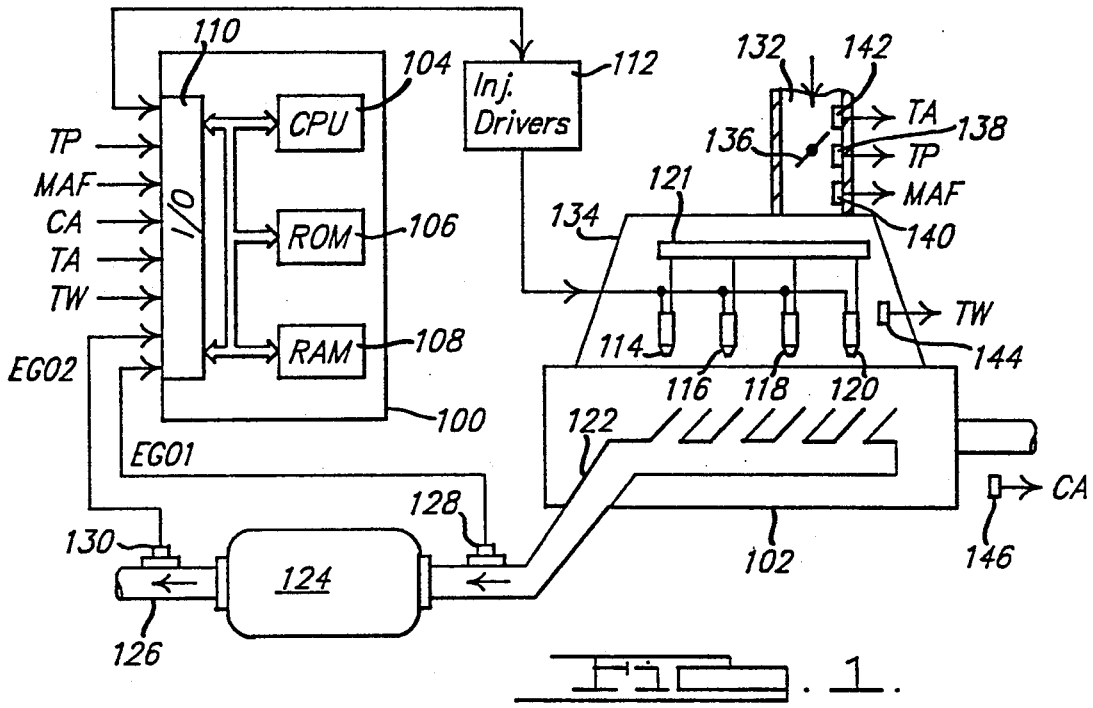
FIG. 1 is a schematic view of an internal combustion engine including an embodiment of this invention.

Referring to FIG. 1, microcomputer 100 is shown for controlling an air/fuel ratio supplied to an internal combustion engine 102. Microcomputer 100 further comprises a central processing unit (CPU) 104, a read-only memory (ROM) 106 for storing main routine and other routines such as a fuel flow routine and calibration constants, tables, etc., a random access memory (RAM) 108, and a conventional input/output (I/O) interface 110. Interface 110 includes analog to digital (A/D) converters for converting various analog input signals and digital inputs, digital to analog (D/A) converters for converting various analog output signals and digital outputs.

Microcomputer 100 also includes conventional elements such as a clock generator and means for generating various clock signals, counters, drivers, and the like (not shown). Microcomputer 100 controls the air/fuel ratio by energizing injector drivers 112 in response to various measured operating parameters of engine 102. Microcomputer 100 can fetch input parameters and can perform calculations of control signals at a fixed sampling rate DELTAT such as, for example, 20 msec. If microcomputer 100 is designed to operate with a variable sampling rate, a timer which can perform time measurement between two successive samplings and assign measured sampling time to DELTAT can be provided.

Engine 102, in this particular example, is shown as a conventional four cylinder gasoline engine having fuel injectors 114, 116, 118, and 120 coupled to a fuel rail 121. Each fuel injector is electronically activated by respective signals from injector drivers 112. Each of the injectors 114, 116, 118, and 120 is also coupled in a conventional manner to respective combustion cylinders 1, 2, 3, and 4 (not shown). Exhaust gases from each of the combustion cylinders 1, 2, 3, and 4 are routed to an exhaust manifold 122 and are discharged through a three way catalytic converter 124 which removes simultaneously three pollutants CO, HC, and NOx from the exhaust gas, and exhaust pipe 126. Provided in the concentration portion of the exhaust manifold 122, upstream of the catalyst 124, is a first EGO (EGO1) sensor 128 for detecting an oxygen concentration in the engine exhaust gases. Further provided in the exhaust pipe 126, downstream of the catalyst 124, is a second EGO (EGO2) sensor 130 for detecting an oxygen concentration after catalyst 124. Both EGO sensors 128 and 130 generate output voltage signals which are transmitted to the A/D converter of I/O interface 110.

Intake air 132 is shown coupled to intake manifold 134 for inducting air past throttle plate 136 into combustion cylinders. Throttle position sensor 138 is shown coupled to throttle plate 136 for providing a throttle position signal TP. Also coupled to intake manifold 134 are mass airflow sensor 140 for providing mass airflow signal MAF related to the mass airflow induced into engine, and air temperature sensor 142 for providing a signal TA indicative of the temperature of induced air. Coupled to a cylinder block of engine 102 is a cooling water temperature sensor 144 for providing signal TW indicative of the coolant temperature. Crank angle position sensor 146 is shown coupled to a crankshaft of engine 102 for providing crank angle position signal CA indicative of crank position.

A manifold pressure sensor MAP may be used instead of a mass airflow sensor 140 to provide an indication of engine load by known techniques. Other conventional components necessary for engine operations such as a spark delivery system are not shown in FIG. 1. It is also recognized that the invention may be used to advantage with other types of engines, such as engines having a number of cylinders other than four.

Figure 2:
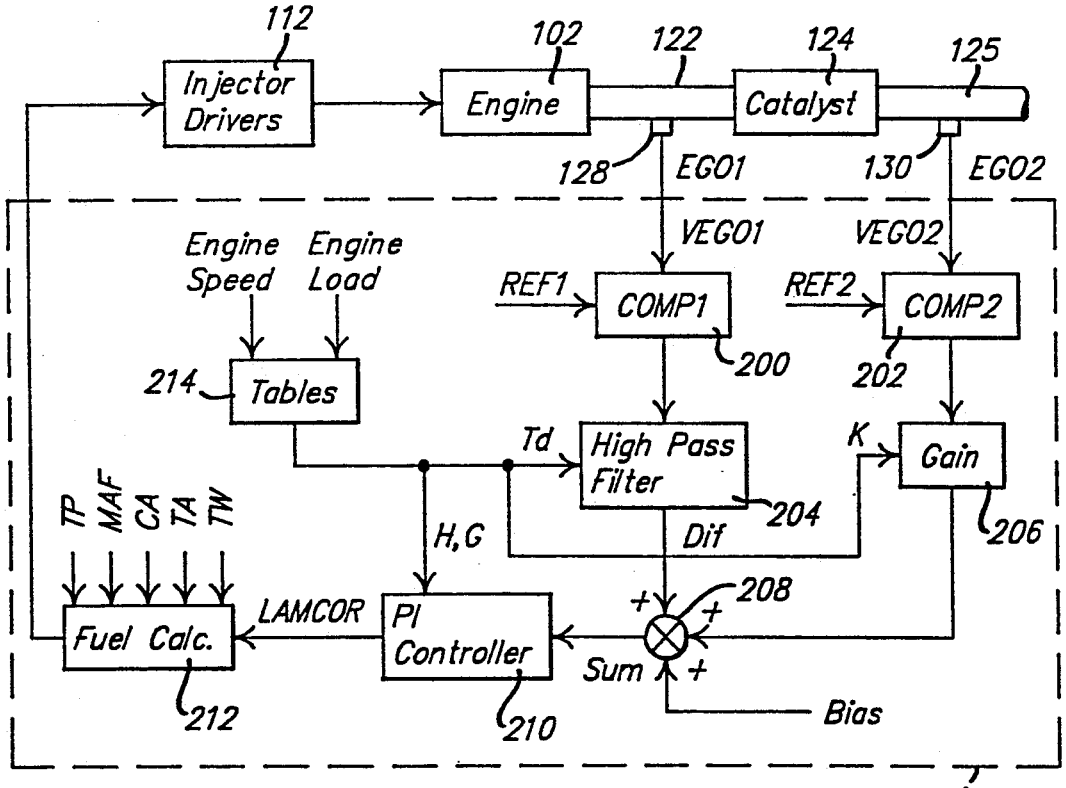
FIG. 2 is a control block diagram of a dual EGO sensor closed loop fuel control system according to the invention.
Figure 3:
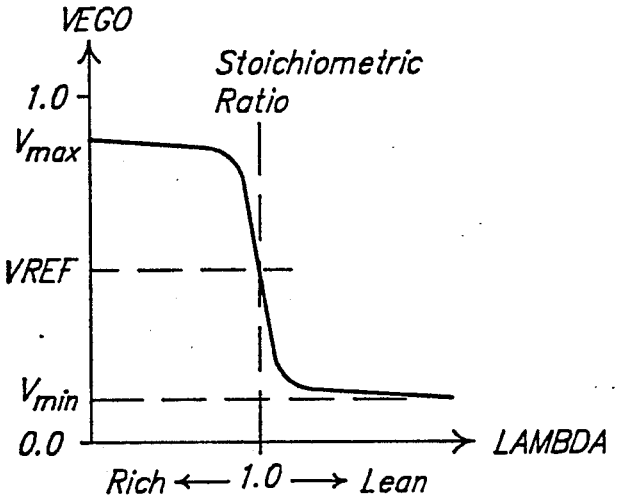
FIG. 3 is a graph showing typical voltage output of an EGO sensor as a function of air/fuel ratio.

The operation of a dual EGO sensor closed loop fuel control system in controlling air/fuel ratio is now described with particular reference to a control block diagram shown in FIG. 2 and the associated graph in FIG. 3 showing EGO sensor output voltage VEGO vs LAMBDA, an air/fuel ratio relative to air/fuel stoichiometric ratio. In FIG. 2, microcomputer 100, engine 102, injector drivers 112, exhaust manifold 122, catalyst 124, exhaust pipe 125, and EGO sensors 128 and 130 have been previously described with reference to FIG. 1.

Output voltages VEGO1 and VEGO2 from upstream EGO1 sensor 128 and downstream EGO2 sensor 130 are fed through A/D converter (not shown) to respective comparators 200 and 202. Each comparator is supplied with reference signals REF1 and REF2 respectively which are indicative of an EGO output voltage at stoichiometric ratio as shown in FIG. 3. Each comparator 200 and 202 produces an output signal COMP1 and COMP2 respectively in such a way that their absolute values are equal but vary in sign depending upon which side of stoichiometric ratio are EGO output voltage signals VEGO1 and VEGO2 respectively. The output COMP1 of comparator 200 is modified by a corrective block 204. Corrective block 204 is advantageously a high pass filter which in this embodiment is presented as a first order high pass filter but is not limited to be a first order filter and may be a higher order high pass filter.

The first order high pass filter, also known in the control field as a real time differentiator, may be described by the following differential equation:

$$T_d*d(DIF)/dt+DIF=d(COMP1)/dt \quad \text{(Eqn. 1)}$$

where:

DIF—the first order high pass filter output signal;

$T_d$—time constant of said filter, calibratable parameter of the control system;

d( . . . )/dt—symbol indicating the first derivative of the respective signal.

The difference equation suited for digital microcomputer computations is derived from (Eqn. 1) and in the simplest form is:

$$DIF(i)=(1-DELTAT/T_d)*DIF(i-1)+(COMP1(i)-COMP1(i-1))$$

where: DELTAT—microcomputer sampling rate discussed above; i and i−1 indicate current and previous results of calculations or measurements.

The output COMP2 of the second comparator 202 is connected to gain block 206 with a constant gain K so that output signal of comparator 202 is equal to K*COMP2. Output signals of both comparators 200 and 202 are summed together with an additional bias signal BIAS by a summing block 208. Said bias signal BIAS is provided for calibration purposes only serving to modify reference signal REF2 if so desired. The output signal SUM of the summing block is equal $$SUM=DIF+K*COMP2+BIAS \quad \text{(Eqn. 2)}$$

and is fed to a controller block 210. Controller block 210 performs calculation corresponding to proportional and integral (PI) controller which is described by the following differential equation:

$$d(LAMCOR)/dt=H*d(SUM)/dt+G*SUM \quad \text{(Eqn. 3)}$$

where:

LAMCOR—output signal of PI controller which represents air/fuel ratio correction amount;

H and G—jumpback and ramp respectively of the PI controller, calibratable parameters of the control system.

The difference equation suited for digital microcomputer computations is derived from (Eqn. 3) and in the simplest form is: LAMCOR(i)=LAMCOR(i−1)+H*(SUM(i)−SUM(i−1))+G*DELTAT*SUM(i−1). Those skilled in the art will recognize that presentation of the differential equations (Eqn.1) and (Eqn.3) in the form of the difference equations may be done in different form. Control system calibratable parameters H, G, K, and Td may be modified as a function of speed/load tables (214). Also, though this description is related to microcomputer realization, the control system described so far can be easily converted to a realization by analog means, shown later.

Fuel calculation block 212 calculates fuel flow control signal in a conventional manner using an air/fuel correction amount LAMCOR, and provides signals to injector drivers 112.

Figure 4:
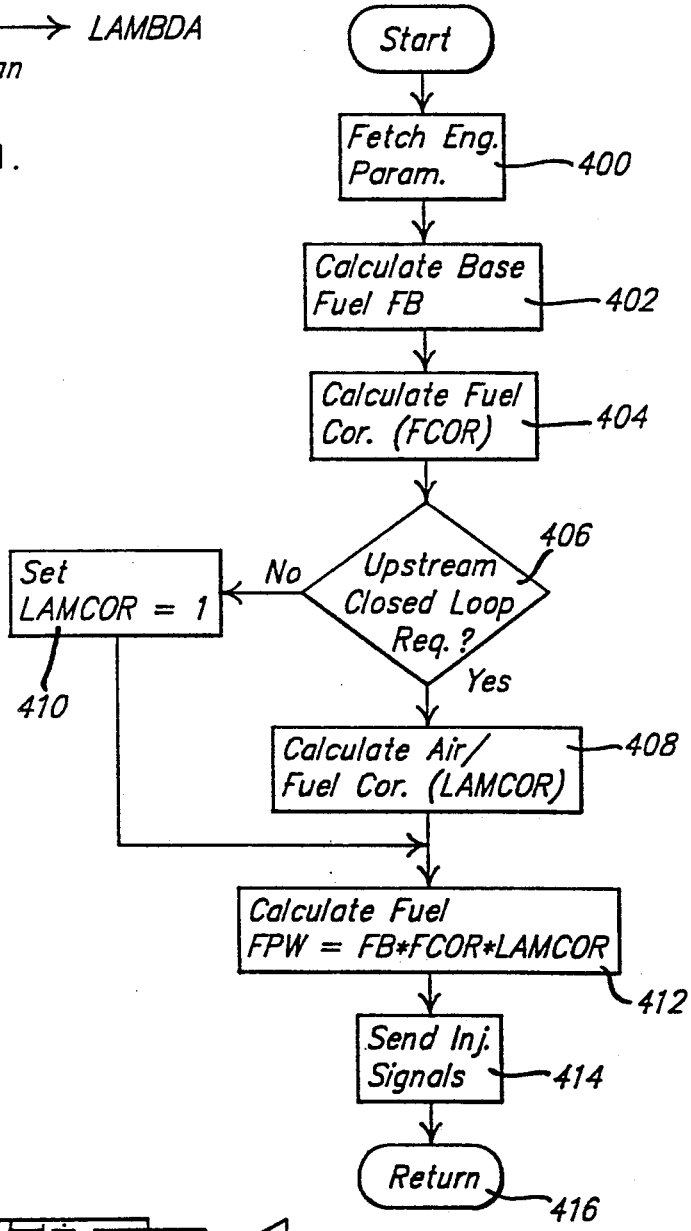
FIG. 4 is a flowchart illustrating various process steps performed to calculate fuel flow rate in accordance with an embodiment of this invention.

The operation of microcomputer 100 in controlling fuel flow is now described with particular reference to the flowchart shown in FIG. 4. The operations, or steps, described herein below are performed for each cylinder. However, cylinder identification and injector driver selection is not explicitly mentioned.

At the start of each sampling interval engine parameters are fetched in step 400. Engine speed and load are then computed in a conventional manner from crank position signal CA and mass airflow signal MAF. During step 402, base open loop fuel injection amount FB is determined by look-up and interpolation of speed/load table from ROM 106 storage. At step 404, fuel correction amount FCOR is calculated based on, for example, engine warming up temperatures of intake air TA and cooling water TW, battery voltage, and the like.

Step 406 checks if upstream EGO sensor 128 is warmed-up to start closed loop operation. These conditions may be, but are not limited to, cooling water temperature TW reaching certain limit, inlet air temperature TA, observed EGO sensor switching, elapsed time since start, and the like. Also, some engine operations such as wide open throttle or prolonged idle may require open loop control even after other closed loop conditions are met. All these closed loop requirements are checked in step 406 and, if closed loop is called for, step 408 calculates air/fuel ratio correction amount LAMCOR. Otherwise, in step 410 LAMCOR is set to 1. Calculations of LAMCOR in step 408 will be explained later in more detail. Logic flow from both step 410 and 408 goes to step 412 which calculates a final fuel flow FPW based on the main fuel flow equation:

$$FPW=FB*FCOR*LAMCOR$$

and energizes fuel injectors in step 414. Step 416 returns fuel flow calculation routine to the main routine.

Figure 5:
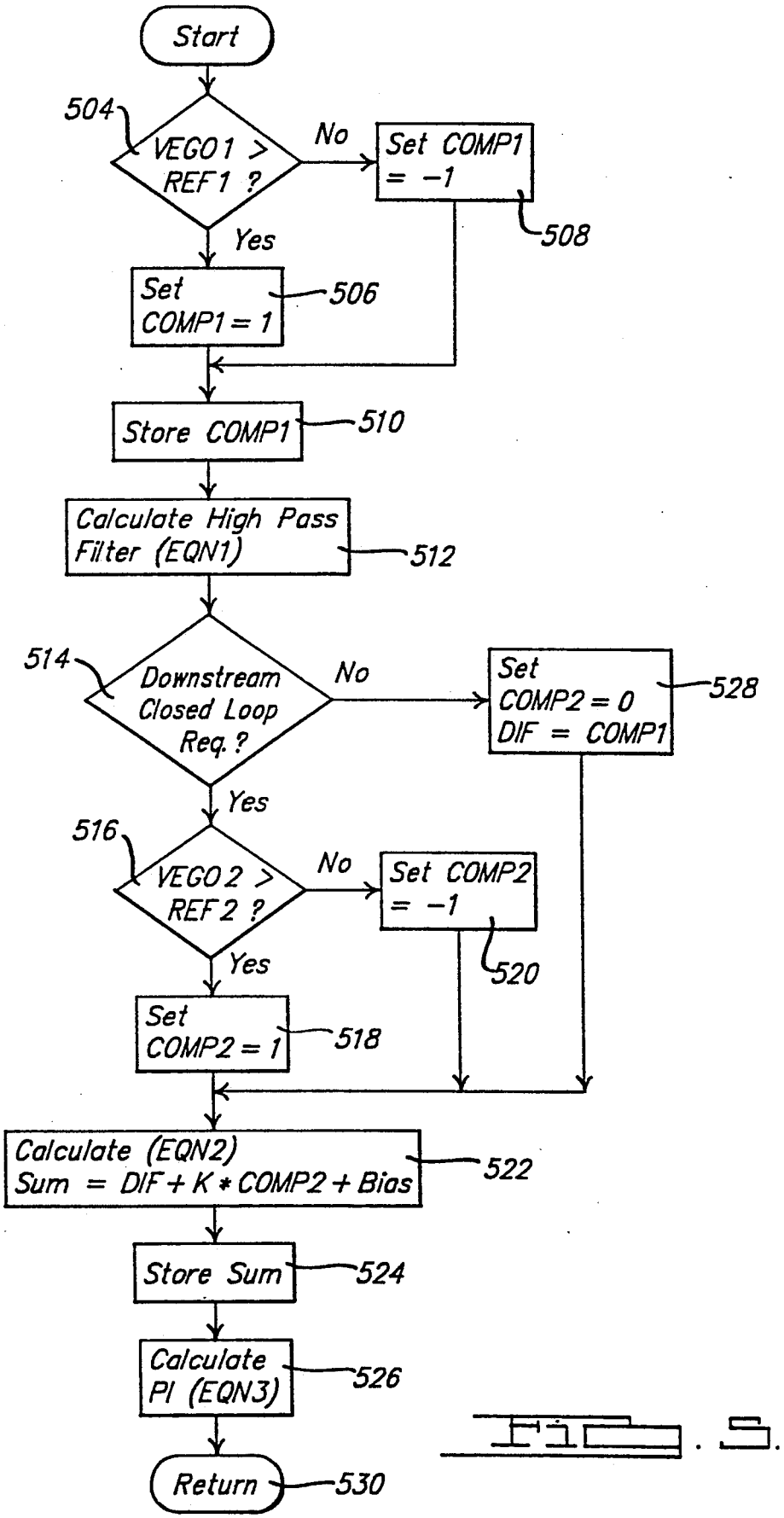
FIG. 5 is a flowchart illustrating various process steps performed to calculate an air/fuel ratio correction amount according to the invention.

The calculation of air/fuel ratio correction amount LAMCOR in step 408 is now described with particular reference to the flowchart shown in FIG. 5. Steps 504, 506, and 508 describe the first comparator 200 and compute its output COMP1. The value of COMP1 is stored in RAM 108 in step 510 for use in the next sampling interval. Step 512 performs computation pertinent to (Eqn.1) which describes high pass filter 204. Then, step 514 checks if downstream EGO sensor 130 is warmed up to start second closed loop operation. These conditions are similar but may be different from the conditions for upstream EGO sensor 128 provided above (see step 406). If said conditions are met, steps 506, 518, and 520 compute the output COMP2 of the second comparator 202.

Step 522 represents summing block 208 and computes (Eqn.2). The output value SUM from step 522 is stored in RAM 108 in step 524 for use in the next sampling interval. Step 526 performs computation pertinent to (Eqn.3) which describes PI controller 210. Step 530 returns this routine to step 412 of fuel flow calculations. If above mentioned conditions in step 514 are not met, step 528 sets COMP2 equal to 0, and P/F equal to COMP1 thus disabling the second closed loop operation and high pass filter. Step 528 then proceeds to step 522 providing automatic transfer from one EGO to dual EGO sensor closed loop fuel control.

Figures 6, 7:
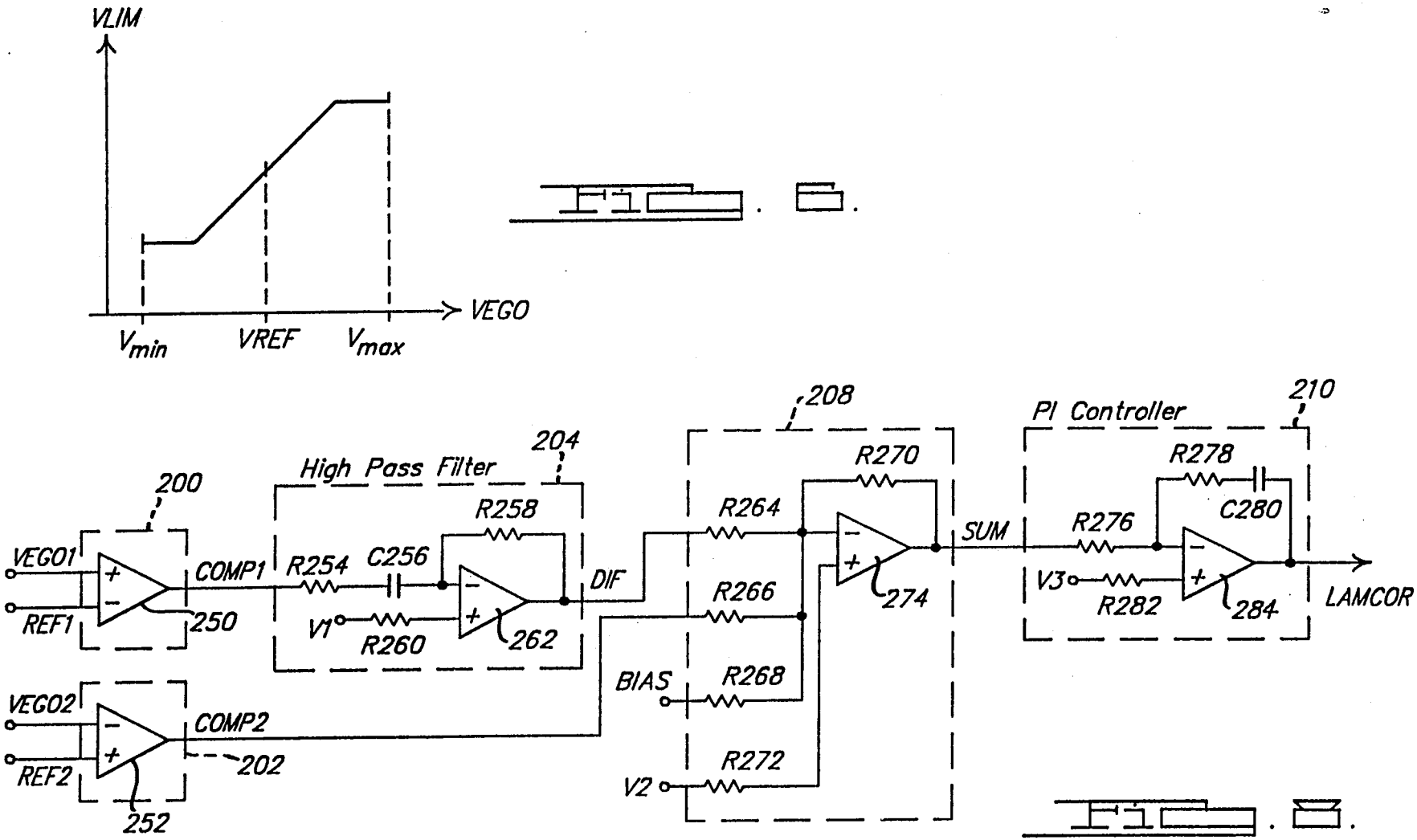
FIG. 6 is a graph showing typical voltage output of a limiter used in accordance with another embodiment of the invention.
FIG. 7 is a flowchart illustrating various process steps performed to calculate air/fuel ratio correction amount according to the second embodiment of the invention.
Figure 7:
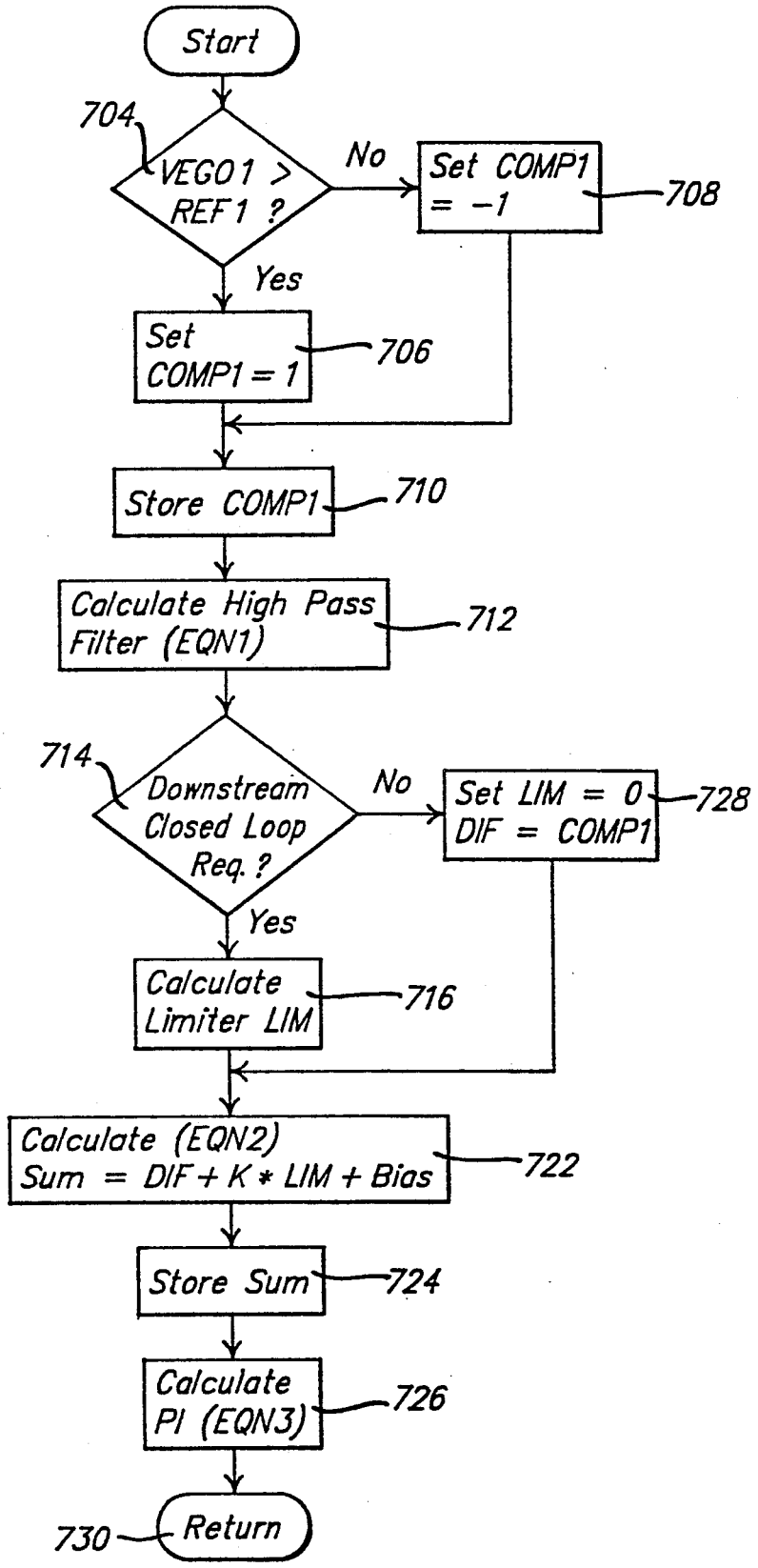

In another embodiment of the invention, limiting block 202' is substituted in FIG. 2 instead of the second comparator 202. Voltage characteristic of the limiter shown in FIG. 6 has a gain of 1 in vicinity of the reference voltage, and its upper and lower limits are set symmetrical about said reference and do not extend beyond minimum $V_{min}$ and maximum $V_{max}$ voltages of EGO sensor output signal VEGO. Flowchart describing calculations of air/fuel ratio correction amount LAMCOR for this embodiment is similar to the main embodiment, and is shown in FIG. 7. In this case, step 716 performs computations pertinent to a limiter 202'.

It is understood that during different engine operations specifically at different speeds and loads, control system calibratable parameters may require readjustments for optimal control. These parameters are jumpback H and ramp G of PI controller 210, time constant $T_d$ of high pass filter 204, gain K of gain block 206, and bias BIAS to summer block 208. To achieve a recalibration of all or any combination of said parameters, a number of functions or tables (e.g., table 214 in FIG. 2) with engine speed and load as inputs may be incorporated in the flowcharts shown in FIG. 5 and 7. It is also understood that certain measures, like time delays or low pass filters, may be employed to protect the control system from effects of high frequency EGO sensor switching. Such modifications may be incorporated into the invention.

FIG. 8 shows a preferred embodiment in a circuit form for the control logic described in elements 200, 202, 204, 206, 208, and 210 of FIG. 2. Output voltage VEGO1 from upstream EGO1 sensor 128 after signal conditioner and possible low pass filter (both not shown) is applied to the input of a comparator 200 which is represented by an operational amplifier 250. Reference voltage REF1 is provided by a regulated voltage source V and a resistor network (not shown) and is applied to the second input of an operational amplifier 250. Similarly, output voltage VEGO2 from downstream EGO2 sensor 130 and reference voltage REF2 provided by another resistor network are applied to the inputs of a comparator 202 which is represented by an operational amplifier 252.

Resistors R254, R258, and R260, capacitor C256, and operational amplifier 262 comprise high pass filter 204. Reference voltage V1 is set at a level midway between the low and high voltage outputs of amplifier 250 so that amplifier 262 may operate with a single polarity voltage source. Reference voltages V2 for operational amplifier 274 and V3 for operational amplifier 284, both will be described later, serve the same purposes. The product of R254 and C256 corresponds to high pass filter time constant $T_d$ in equation (1). Output signals DIF from operational amplifier 262, COMP2 from operational amplifier 252, and a BIAS voltage are applied to a resistor network of resistors R264, R266, and R268. The resistor network together with feedback resistor R270 and operational amplifier 274 correspond to summing block 208.

The value of resistor R266 is responsible for providing gain K of gain block 206. Output signal SUM from operational amplifier 274 is applied to resistor R276 which together with resistors R278 and R282, capacitor C280, and operational amplifier 284 comprise PI controller 210. Ratio R278 to R276 corresponds to PI controller jumpback H, and product R276 and C280 corresponds to PI controller ramp G, both H and G as used in equation (3). Output signal LAMCOR from operational amplifier 284 may be used in main fuel equation or drive fuel injectors not shown in FIG. 8. This concludes description of electrical circuit.

FIG. 9 shows typical traces of a fuel system with dual EGO sensor closed loop fuel control at a steady state engine operation. Upper trace 9A is output of upstream EGO1 sensor, middle trace 9B is output of downstream EGO2 sensor, and lower trace 9C is PI controller output LAMCOR. Those skilled in the art will recognize a typical limit cycle generated by upstream EGO1 sensor. The frequency of said limit cycle is mainly determined by parameters of upstream portion of control system, and thus being close to a single upstream EGO sensor control system. However, downstream EGO2 sensor provides a bias which shifts upstream EGO1 sensor down making said limit cycle not symmetrical around its reference voltage REF1. In the same time, the output of downstream EGO2 sensor is centered around its reference voltage REF2. Output of PI controller exhibits two jumps: the first jump indicated by numerical 1 is due to upstream EGO1 sensor crossing its reference voltage REF1, and the second jump indicated by numerical 2 is due to downstream EGO2 sensor crossing its reference voltage REF2.

This concludes the description of the preferred embodiment. The reading of it by those skilled in the art will bring to mind many further alterations and modifications without departing from the spirit and scope of the invention. Accordingly, it is intended that the scope of the invention be limited to only the following claims.

What is claimed:

1. An apparatus for controlling air/fuel ratio in an internal combustion engine having means for supplying air and fuel in variable ratio to said engine, exhaust means including exhaust manifold, catalytic converter and exhaust piping, and two EGO sensors responsive to certain oxygen concentration in the exhaust gases, said EGO sensors located one upstream and another downstream of said catalytic converter, said apparatus comprising:

a first means for generating a first signal indicative of an air/fuel ratio in said exhaust manifold upstream of said catalytic converter, the first means being a first comparator;

a second means for generating a second signal indicative of an air/fuel ratio in said exhaust piping downstream of said catalytic converter;

a third means responsive to the first signal and generating a third signal, the third means being a high pass filter;

a fourth means responsive to the second signal, the fourth means being a gain block;

a fifth means for generating a bias signal;

a sixth means responsive to a combination of the third signal, a scaled second signal, and the bias signal, and generating a fourth signal, the sixth means being a summing block;

a seventh means responsive to the fourth signal and generating the air/fuel ratio correction amount, the seventh means being a proportional and integral controller; and an adjustment means for adjusting an engine air/fuel ratio in accordance with said air/fuel ratio correction amount.

2. An apparatus for controlling air/fuel ratio as recited in claim 1 wherein said second means is a second comparator.

3. An apparatus for controlling air/fuel ratio as recited in claim 1 wherein said second means is a limiter.

4. An apparatus for controlling air/fuel ratio in an internal combustion engine having means for supplying air and fuel in variable ratio to the engine, exhaust means including exhaust manifold, catalytic converter and exhaust piping, and two EGO sensors responsive to certain oxygen concentration in exhaust gases, said EGO sensors being located one upstream and one downstream of said catalytic converter said apparatus comprising;

a high pass filter coupled to said upstream EGO sensor;

a summer coupled to an output of said high pass filter as one input, coupled to an output of said downstream EGO sensor as a second input and coupled to a bias signal;

a proportional and integral controller coupled to the output of said summer; and a fuel calculation means coupled to the output of said proportional and integral controller for generating a signal to determine the amount of fuel to be injected into the engine.

5. An apparatus for controlling air/fuel ratio as recited in claim 4 further comprising a gain means coupled to said downstream EGO sensor for generating a sealed signal indicative of an air/fuel ratio in said exhaust piping downstream of said catalyst, said gain means having an output coupled to said summer.

6. A method for controlling air/fuel ratio in an internal combustion engine including supplying air and fuel in variable ratio to the engine, passing the exhaust gas through a catalytic converter, positioning a first EGO sensor upstream of the catalytic converter and a second EGO sensor downstream of the catalytic converter for sensing the oxygen concentration in the exhaust gas, said method comprising:

generating a first signal from the upstream EGO sensor indicating the oxygen concentration in the exhaust gas at that Point;

generating a second signal from the downstream EGO sensor indicating the oxygen concentration in the exhaust gas at that point;

passing the first signal through a high pass filter;

passing the output of the high pass filter to a summer;

applying a signal from the downstream EGO sensor to the summer;

applying the outcome of the summer to a proportional and integral controller; and applying the output from the proportional and integral controller to a fuel calculation means for calculating a desired fuel amount to be induced into the engine.

7. A method of controlling air/fuel ratio in an internal combustion engine including supplying air and fuel in variable ratio to the engine, passing the exhaust gas through a catalytic converter, positioning a first EGO sensor upstream of the catalytic converter and a second EGO sensor downstream of the catalytic converter for sensing the oxygen concentration in the exhaust gas, said method including the steps of:

fetching engine operating parameters;

applying the engine operating parameter to a proportional and integral controller;

calculating a base fuel feedback parameter in the proportional and integral controller using the engine operating parameters;

calculating a fuel correction parameter;

determining whether closed loop is required;

if closed loop is required calculating an air/fuel correction factor;

if closed loop is not required setting the air/fuel correction factor equal to 1;

calculating the desired amount of fuel for engine operation;

generating injector signals indicative of the desired amount of fuel; and returning to the start of the logic flow to repeat the previous steps.

8. A method as recited in claim 7 wherein the step of calculating the air/fuel correction factor includes the steps of:

determining whether a voltage indicative of a first signal from the upstream EGO sensor is greater than a first reference voltage;

if yes, setting a first comparator output equal to 1;

if no, setting a first comparator output equal to −1;

storing the output of the first comparator;

calculating an output of a high pass filter as a function of the first comparator;

determining whether closed loop operation is be done as a function of the downstream exhaust gas oxygen sensor;

if not, setting a second comparator output equal to 0 and a difference equal to the output of the first comparator;

if closed loop operation is done, determining if the voltage of the downstream EGO sensor is greater than a second reference voltage;

if not, setting a second comparator output equal to 1;

if yes, setting a second comparator output equal to 1;

calculating a sum as being equal to the difference plus the sum of a constant times the second comparator output and a bias;

storing the sum; and calculating a proportional and integral value for use in controlling fuel.

9. A method as recited in claim 7 wherein the steps of calculating the air/fuel ratio correction factor include:

comparing a voltage from the upstream exhaust gas oxygen sensor to a first reference voltage, if it is not greater setting a first comparator output equal to −1, if it is greater setting the first comparator output equal to 1;

storing the value of the output of the first comparator;

calculating an output of the high pass filter as a function of the first comparator;

determining whether closed loop operation is done in connection with a second exhaust gas oxygen sensor;

if no, setting a second comparator equal to 0 and setting a difference parameter equal to the output of the first comparator;

if yes, calculating the limiter output;

calculating a sum equal to the difference plus a constant times the limiter output plus a bias;

storing the sum; and calculating a proportional and integral value for use in controlling fuel.

* * * * *